US009927742B2

(12) United States Patent
Hirota

(10) Patent No.: US 9,927,742 B2
(45) Date of Patent: Mar. 27, 2018

(54) IMAGE FORMING APPARATUS

(71) Applicant: CANON KABUSHIKI KAISHA, Tokyo (JP)

(72) Inventor: Kenichi Hirota, Joso (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/228,931

(22) Filed: Aug. 4, 2016

(65) Prior Publication Data

US 2017/0052487 A1 Feb. 23, 2017

(30) Foreign Application Priority Data

Aug. 17, 2015 (JP) ..... 2015-160539

(51) Int. Cl.
*G03G 15/16* (2006.01)
*G03G 15/01* (2006.01)
*G03G 15/00* (2006.01)

(52) U.S. Cl.
CPC ..... *G03G 15/1615* (2013.01); *G03G 15/0131* (2013.01); *G03G 15/0189* (2013.01); *G03G 15/5058* (2013.01); *G03G 15/6594* (2013.01); *G03G 2215/0158* (2013.01)

(58) Field of Classification Search
None
See application file for complete search history.

(56) References Cited

U.S. PATENT DOCUMENTS

2009/0142083 A1* 6/2009 Minbu ..... G03G 15/6594 399/45
2015/0362868 A1* 12/2015 Sone ..... G03G 15/1615 399/49
2017/0052485 A1* 2/2017 Yamamoto ..... G03G 15/5058

FOREIGN PATENT DOCUMENTS

JP 2005-138575 A 6/2005
JP 2008-281931 A 11/2008
JP 2012-93609 A 5/2012
JP 2012-168249 A 9/2012

* cited by examiner

*Primary Examiner* — Thomas Giampaolo, II
(74) *Attorney, Agent, or Firm* — Canon USA, Inc. I.P. Division

(57) ABSTRACT

An image forming apparatus including: a toner image forming unit forming a toner image on an intermediate transfer member; a transfer member transferring the toner image on the intermediate transfer member to a recording material in a transfer portion; a driving source applying driving force to the transfer member independently of an intermediate transfer member driving source; an execution unit correcting image misalignment on the basis of a detection result of a test toner image on the intermediate transfer member when no toner image exists in the transfer portion; a container storing the recording material; and an input unit associating the container with a group related to basic weight and surface properties of the recording material. The apparatus includes a driving unit driving the driving source at a speed corresponding to the group if the recording material stored in the container associated with the group is used for image formation.

13 Claims, 10 Drawing Sheets

FIG. 4C
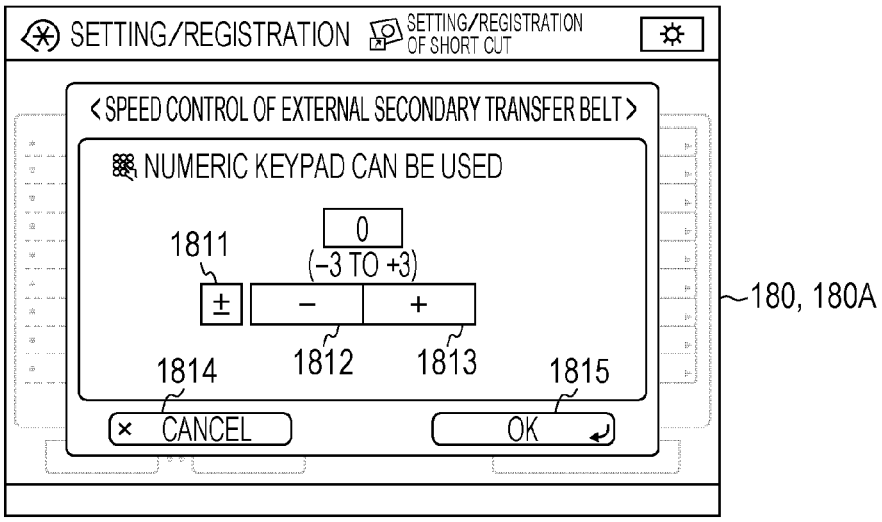
FIG. 4D
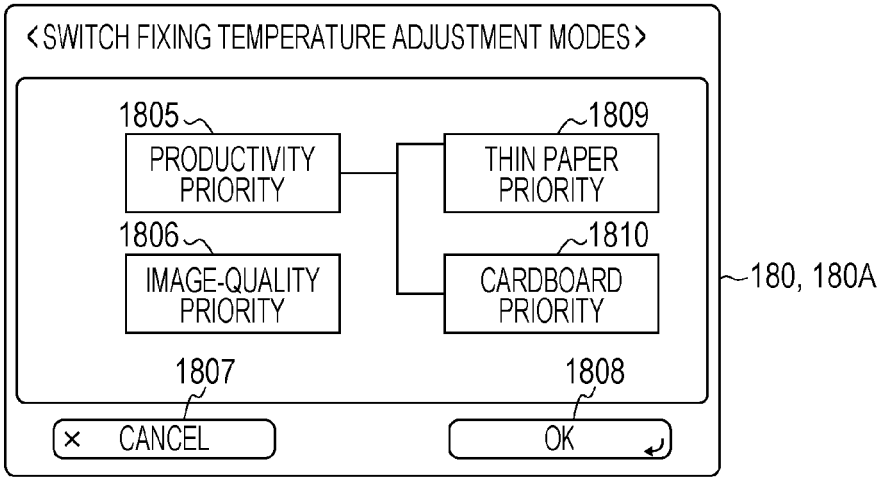
FIG. 4E
| | MODE 1 | MODE 2 |
|---|---|---|
| BASIC WEIGHT | IMAGE-QUALITY PRIORITY | PRODUCTIVITY PRIORITY |
| LESS THAN 150 gsm | 150°C | 160°C |
| | 0.60% | 0.60% |
| 150 gsm OR GREATER | 170°C | 160°C |
| | 1.50% | 0.60% |

IMAGE FORMING APPARATUS

BACKGROUND OF THE INVENTION

Field of the Invention

The present invention relates to an image forming apparatus, such as a printer and a digital multifunction imaging apparatus.

Description of the Related Art

Regarding image forming apparatuses especially for business use, there exists a demand for a higher level of image property (i.e., color stability and reduction in image roughness) of images printed on a sheet as a recording material recently. The image property at a high level is demanded in a wide range of media, from thin paper of about 50 gsm of basic weight used for, for example, printing flyer or direct mail, to a cardboard of about 400 gsm used for package printing, for example.

Especially in an electrophotographic image forming apparatus, in order to stably transfer a printing image from an image bearing member to a sheet, images are formed independently in each color and the formed color images are registered on an intermediate transfer member (a belt or a roller) (primary transfer). The registered image is then secondarily transferred to the sheet (a secondary transfer system).

Since a disturbance factor caused by the physical properties of the sheet during registration of the colors can be eliminated by the intermediate transfer member, the secondary transfer system is advantageous in easily obtaining stable image transferability compared with a direct transfer system in which colors are registered directly on the sheet.

In order to enable an image forming apparatus of the secondary transfer system to print on various types of sheets, an external secondary transfer belt is desirably used at a portion at which an image is transferred from the intermediate transfer member to the sheet. This is because the external secondary transfer belt provides high transferability also when a sheet with unevenness on its surface, such as embossed paper, is used, or provides improved sheet conveyance property in the secondary transfer portion since it is possible to stick the sheet to the external secondary transfer belt with bias charge during transfer.

When the external secondary transfer belt is used, since the sheet substantially sticks to the external secondary transfer belt, the conveyance speed of the sheet is substantially the same as the surface velocity of the external secondary transfer belt. Since the sheet is conveyed sticking to the external secondary transfer belt, the conveyance speed of the sheet is determined by the surface velocity of the belt with substantially small fluctuation. Therefore, stable image magnification is obtainable by driving the external secondary transfer belt at a constant speed.

The sheet conveyance speed is stabilized by driving the external secondary transfer belt at a constant speed, however, a speed difference is caused due to a small difference in the curvature radius inside a secondary transfer nip between the intermediate transfer member and the sheet surface. In order to make the sheet surface velocity the same as the surface velocity of the intermediate transfer member, the driving speed of the external secondary transfer belt needs to be controlled optimally depending on the type of the sheet.

In the related art which employs a secondary transfer roller, a driving source for an intermediate transfer belt and a driving source for the secondary transfer roller are prepared independently. The sheet conveyance speed may vary depending on the thickness of the sheet. Therefore, adjusting the secondary transfer roller speed depending on the thickness of the sheet is known. (see Japanese Patent Laid-Open No. 2008-281931).

In a secondary transfer system which employs an elastic material on a surface of the intermediate transfer medium and a non-elastic material as an external secondary transfer belt, a speed difference between an intermediate transfer belt surface and a sheet surface may be caused due to the existence of a sheet material in the secondary transfer portion. As the sheet enters a secondary transfer nip, the shape of the secondary transfer nip changes, and the speed relationship between the intermediate transfer belt and the secondary transfer portion in the secondary transfer nip changes from the speed relationship before the sheet enters.

It is known that the optimal surface velocity setting of the external secondary transfer belt necessary to provide the optimal image quality for each sheet type cannot be determined only by the thickness of the sheet. Image transfer quality in the secondary transfer nip is influenced greatly by how uniformly the image is transferred to the sheet surface. The slidability between the intermediate transfer member and the sheet in the secondary transfer nip is affected by the slidability of the sheet surface. That is, the optimal external secondary transfer belt speed setting of paper with a low friction coefficient, such as regular paper, and the optimal external secondary transfer belt speed setting of paper with a high friction coefficient, such as gloss coated paper are different from each other depending on the surface properties of the sheet.

If the speed relationship between the intermediate transfer belt and the secondary transfer portion in the secondary transfer nip is adjusted, color misalignment may occur. To avoid occurrence of color misalignment, image formation is interrupted and color misalignment correction control (hereafter, referred to as automatic registration control) is conducted in the related art. Automatic registration control produces, however, downtime. Some users may give priority to productivity over image quality, and such downtime causes problems in satisfying the user demand of image quality or productivity. There may be a configuration in which the automatic registration control is not conducted when the user gives priority to productivity. In an example, the speed relationship between the intermediate transfer belt and the secondary transfer portion cannot be adjusted even if the paper type is changed. In this case, since the speed is uncontrollable, the demand for image quality cannot be satisfied.

SUMMARY OF THE INVENTION

The present invention provides an image forming apparatus that satisfies a user who considers both productivity and image quality as important. The present invention further provides an image forming apparatus in which a speed relationship between an intermediate transfer belt and a secondary transfer portion is adjustable, with priority being given to productivity.

According to an aspect of the present invention, an image forming apparatus, including; an image forming unit configured to form a toner image; a toner bearing member configured to bear the toner image formed by the image forming unit; a transfer member configured to form a transfer nip with the toner bearing member for nipping a recording material and to transfer the toner image born by the toner bearing member to the recording material; a speed control unit configured to control a speed of the transfer member and the toner bearing member, the speed control unit being capable of changing a speed difference between the transfer member and the toner bearing member based on a type of the recording material; a control unit configured to, if the speed difference between the transfer member and the toner bearing member is changed during continuous image formation job, form a registration patch in the toner bearing member based on a changed amount of the speed difference between the transfer member and the toner bearing member, and execute a registration correction mode in which an image formation condition of the image forming unit is controlled on the basis of the registration patch, the control unit executing the registration correction mode if a changed amount of speed by the speed control unit exceeds a predetermined range, and not executing the registration correction mode if the changed amount of speed by the speed control unit does not exceed the predetermined range; and an input unit configured to input a signal for setting an image formation mode, wherein the control unit controls an image formation during the image formation mode so that the changed amount of speed by the speed control unit is limited to the predetermined range regardless of a type of the recording material and the registration correction mode is not executed during continuous image formation.

Further features of the present invention will become apparent from the following description of exemplary embodiments with reference to the attached drawings.

BRIEF DESCRIPTION OF THE DRAWINGS

FIGS. 4A to 4D are diagrams illustrating a medium setting screen of an image forming apparatus according to an embodiment of the present invention. FIG. 4E is a table of an image forming apparatus according to an embodiment of the present invention.

DESCRIPTION OF THE EMBODIMENTS

Hereinafter, preferred embodiments of the present invention are described in detail with reference to the attached drawings.

First Embodiment

Image Forming Apparatus

Figure 1:
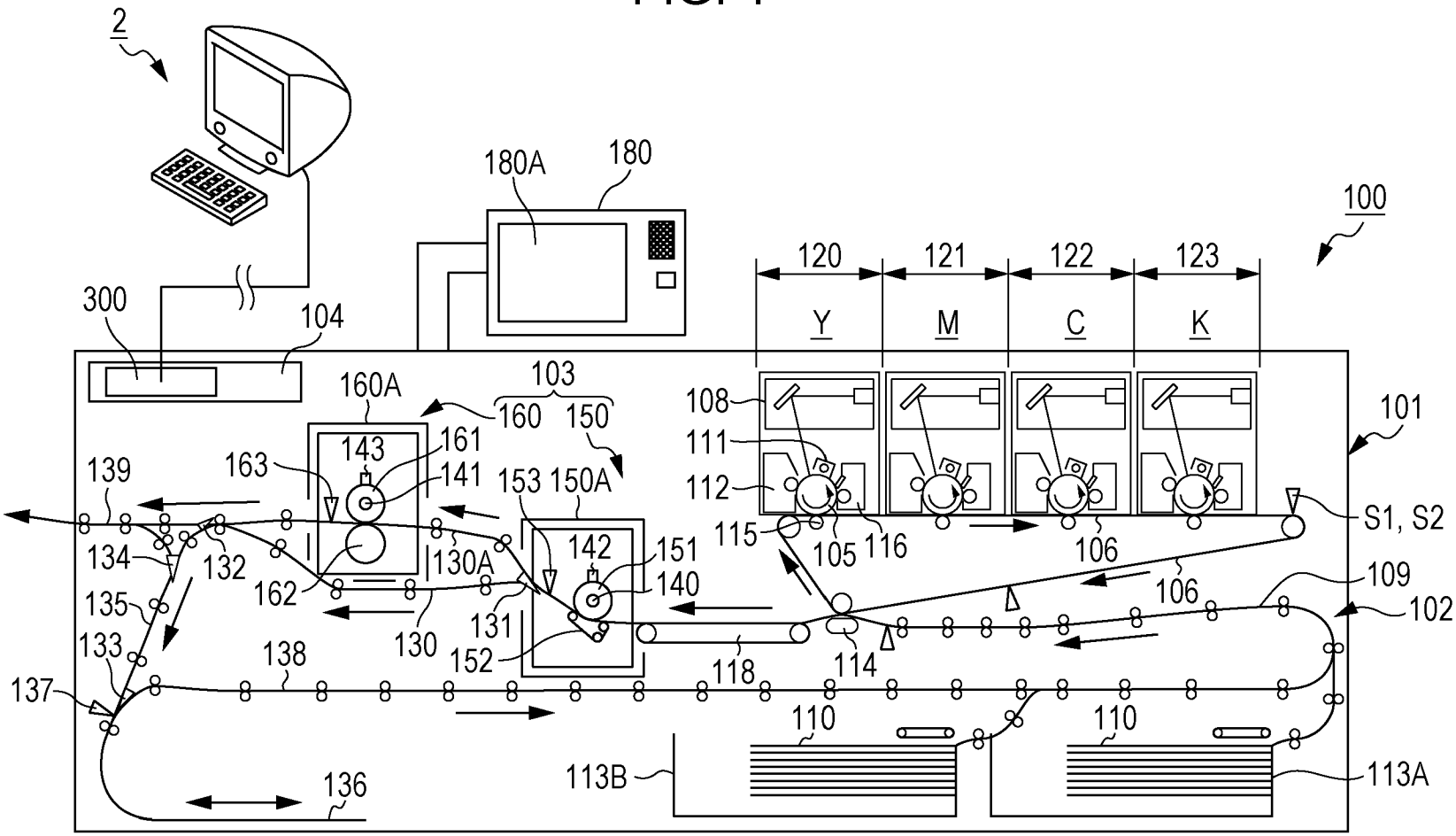
FIG. 1 is a cross-sectional view of an image forming apparatus according to an embodiment of the present invention.

FIG. 1 is a vertical cross-sectional view illustrating a schematic structure of an image forming apparatus 100 according to an embodiment of the present invention. The image forming apparatus 100 is a laser beam printer capable of conducting full color printing (image formation) on a sheet 110 which employs an electrophotographic system as an image formation system.

The image forming apparatus 100 includes a housing (an apparatus main body) 101, and a user interface (an operation unit) 180 provided with a display unit 180A, and the like. Mechanisms constituting an engine unit and a control board container 104 are provided in the housing 101. An engine control unit 300 which controls, for example, each printing process (e.g., a sheet feed process) by each mechanism is held in the control board container 104. A personal computer (PC) 2 as an external host device which generates a print job is connected to the engine control unit 300 via a network, and the print job is supplied to the engine control unit 300 from the PC 2.

In the engine unit, image forming stations (toner image forming units) 120, 121, 122 and 123 for forming toner images of four colors of yellow (Y), magenta (M), cyan (C) (the three primary colors of subtractive color mixing) and black (K) are provided (in tandem arrangement). An intermediate transfer belt 106 having an elastic layer as an intermediate transfer member, a sheet conveyance mechanism unit 102, a fixing process mechanism unit 103 including a first fixing unit 150 and a second fixing unit 160 are also disposed in the engine unit.

The image forming stations 120, 121, 122 and 123 are substantially the same electrophotographic image formation mechanisms which form toner images of different colors as described above. In the present embodiment, each of the electrophotographic image formation mechanisms has a rotary drum-shaped electrophotographic photoconductor (hereafter, "drum") 105 as an image bearing member, and a process means which acts on the drum. The process means here includes a primary charger 111, a laser scanner 108, a developing unit 112, a primary transfer roller 115, and a drum cleaner 116. For the ease of illustration, reference numerals of these components are not illustrated regarding the image forming stations 121, 122, and 123.

The toner images of Y, M, C and K formed on the respective drums 105 of the image forming stations 120, 121, 122 and 123 are primarily transferred to the intermediate transfer belt 106 in a sequentially registered (multiply-aligned) manner. A full-color (4-color) toner image of Y, M, C and K is formed on the intermediate transfer belt 106. Since the imaging principle, the imaging process, and the imaging operation in each of the image forming stations 120, 121, 122 and 123 are well known, detailed description is omitted.

A sheet 110 is separately fed out of a sheet storage case 113A or 113B as a first or a second container of the sheet conveyance mechanism unit 102.

The sheet 110 is guided via a conveyance path 109 into a secondary transfer portion which is a contact portion of the intermediate transfer belt 106 and an external secondary transfer belt 114 which is a belt member as a secondary transfer member (a transfer member) at predetermined control timing.

The full-color (4-color) toner image on the intermediate transfer belt 106 is secondarily transferred collectively to the sheet 110.

The sheet 110 is a sheet-shaped material (a medium: a recording material) and may be, for example, regular paper, cardboard, an envelope, a postcard, a label, glossy paper, an OHP sheet, a sheet made of resin, a print sheet, and format paper of various sizes. Hereafter, the sheet may be referred also to as a paper sheet.

In the present embodiment, each of image forming stations 120, 121, 122 and 123, the intermediate transfer belt 106, the external secondary transfer belt 114, and the sheet conveyance mechanism unit 102 are image formation devices that form the toner image on the sheet 110.

The sheet 110 which has left the secondary transfer portion is separated from the intermediate transfer belt 106 and is conveyed to the fixing process mechanism unit 103 by a conveying device 118. The fixing process mechanism 103 in the present embodiment includes the first fixing unit 150 and the second fixing unit 160 which heat and pressurize the toner image secondarily transferred to the sheet 110 in the secondary transfer portion and fix the toner image to the sheet 110.

The first fixing unit 150 includes a fixing roller 151 for applying heat to the sheet 110, a pressing belt 152 for pressing the sheet 110 against the fixing roller 151, and a first fixing sensor 153 for detecting completion of fixing. The fixing roller 151 is a hollow roller provided with a heater 140 inside.

The second fixing unit 160 is located downstream of the first fixing unit 150 in a sheet conveying direction. The second fixing unit 160 applies grossiness to the toner image on the sheet 110 fixed by the first fixing unit 150 or provides fixability. The second fixing unit 160 includes a fixing roller 161, a pressure roller 162, and a second fixing sensor 163. The fixing roller 161 is a hollow roller provided with a heater 141 inside.

That is, in the present embodiment, both the first fixing unit 150 and the second fixing unit 160 are image heating apparatuses each provided with a pair of rotating members for fixing the toner image formed on the sheet 110 with heat and pressure. For example, if it is set to apply a greater amount of glossiness to the sheet 110 or if the sheet 110 requires a greater amount of heat quantity for fixing as in the cardboard, the sheet 110 having passed through the first fixing unit 150 is guided into the second fixing unit 160 via the conveyance path 130A.

The sheet 110 needs not to pass through the second fixing unit 160 depending on the type thereof. In this case, the sheet 110 passes through the conveyance path 130 without passing through the second fixing unit 160. If, for example, the sheet 110 is regular paper or thin paper, and it is not set to apply a greater amount of glossiness to the sheet 110, the sheet 110 having passed through the first fixing unit 150 is conveyed to the conveyance path 130 which bypasses the second fixing unit 160.

Whether the sheet 110 is conveyed to the second fixing unit 160 or the sheet 110 is conveyed bypassing the second fixing unit 160 is determined by switching control of a first flapper 131. A second flapper 132 is a switch-controlled guide member that guides the sheet 110 having passed through the second fixing unit 160 or the sheet 110 conveyed on the conveyance path 130 to a conveyance path 135, or guides the sheet 110 to the discharge path 139 to the outside. The sheet 110 conveyed on the discharge path 139 is discharged out of the image forming apparatus 100.

An end of the sheet 110 guided to the conveyance path 135 passes through a reverse sensor 137 and is conveyed to a reversing unit (a switchback conveyance path) 136. When the reverse sensor 137 detects a trailing end of the sheet 110, the conveyance direction of the sheet 110 is switched. A third flapper 133 is a guide member which guides the sheet 110 to a conveyance path 138 for double-sided image formation. When the sheet 110 is guided to the conveyance path 138, the sheet 110 is again guided to the secondary transfer portion via the conveyance path 109, where the toner image is secondarily transferred to the second surface of the reversed sheet 110. Double-sided image formation is thus completed.

A fourth flapper 134 is a guide member which guides the sheet 110, which has been guided to the conveyance path 135 and then switched back, to the discharge path 139 to the outside. The sheet 110 conveyed on the discharge path 139 is discharged out of the image forming apparatus 100.

In monochrome image formation, an image forming station necessary to form a monochrome image conducts an imaging operation, while other image forming stations conduct no imaging operation with the drums rotating idly.

Secondary Transfer Portion

Figure 2A:
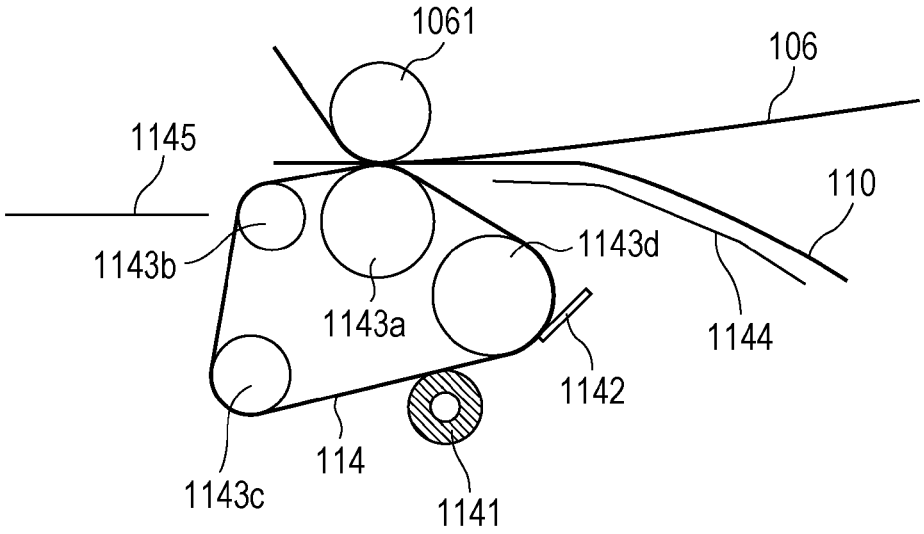
FIG. 2A is a cross-sectional view of a secondary transfer portion according to an embodiment of the present invention.
Figure 2B:
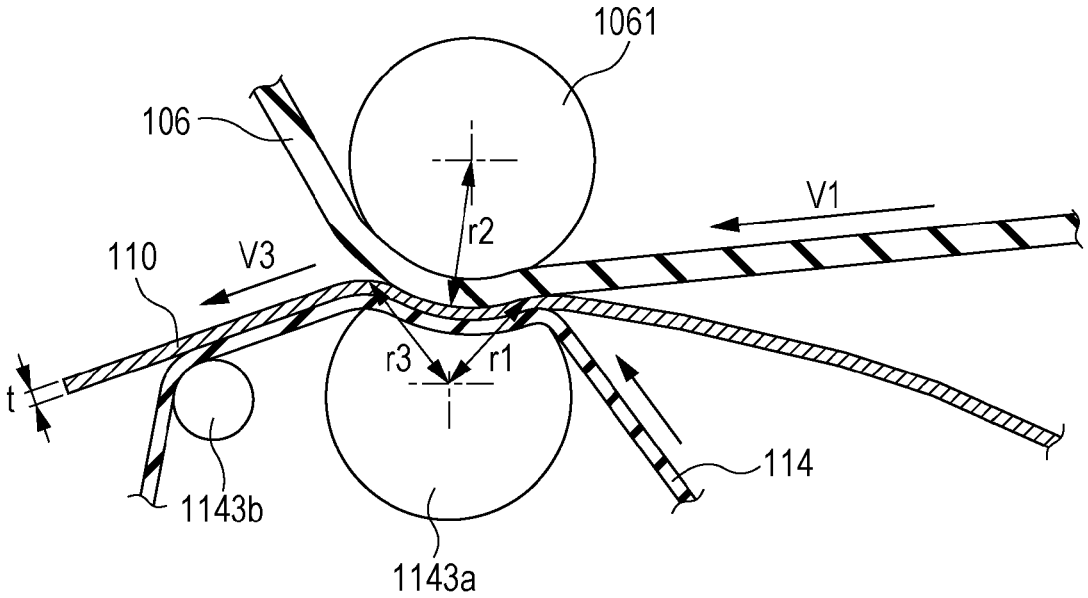
FIG. 2B is a partially enlarged view of the secondary transfer portion.

FIG. 2A is an enlarged view of an external secondary transfer belt 114 which is a secondary transfer member in the present embodiment. FIG. 2B is a further enlarged view of FIG. 2A in which r is a curvature radius from the center of an external secondary transfer roller 1143*a* to a sheet surface, and t is the sheet thickness. When the sheet as the recording medium passes through a transfer nip portion formed between the secondary transfer member and the intermediate transfer member, the toner image primarily transferred to the intermediate transfer member is secondarily transferred to the sheet. Here, in the transfer nip portion, a secondary transfer inner roller 1061 is in contact with the intermediate transfer belt 106 from inside. Predetermined bias is applied to the secondary transfer inner roller 1061.

The external secondary transfer roller 1143*a*, and tension rollers 1143*b*, 1143*c*, and 1143*d* are in contact with the external secondary transfer belt 114 from inside. The external secondary transfer roller 1143*a* is grounded electrically. The toner image on the intermediate transfer belt 106 is transferred to the sheet 110 by electrostatic force when a predetermined transfer current is made to flow through the external secondary transfer roller 1143*a* from the secondary transfer inner roller 1061 via the intermediate transfer belt 106.

A secondary transfer cleaner fur 1141 and a secondary transfer cleaning blade 1142 are provided in an outer periphery of the external secondary transfer belt 114. If toner images of patches for automatic registration control printed on the intermediate transfer belt 106 (described below) or transfer residual toner remaining on the intermediate transfer belt 106 are directly transferred to the external secondary transfer belt 114, these cleaning mechanisms collect toner directly transferred to the external secondary transfer belt 114.

The intermediate transfer belt 106 receives driving force by a later-described driving motor (a first driving source, an intermediate transfer member driving source) M2 and travels at a predetermined surface velocity (a circumferential speed) V1. The external secondary transfer belt 114 is driven by the later-described driving motor (a second driving source independent from the first driving source) M3 and travels at a predetermined surface velocity (a circumferential speed) V2.

The intermediate transfer belt 106 and the external secondary transfer belt 114 may be driven at any speed independently from each other by the driving motor M2 and the driving motor M3, respectively. Therefore, the speed difference (the circumferential speed difference) between V1 and V2 may be reduced to stabilize the geometrical characteristics of the toner image on sheet 110 or, the speed difference (the circumferential speed difference) between V1 and V2 may be provided to improve image transferability (i.e., to reduce image roughness).

Since the surface velocity (the circumferential speed) V1 of the intermediate transfer belt 106 relates to the accuracy in later-described color registration control (the automatic registration control), the surface velocity is controlled highly accurately using an unillustrated encoder, a high-resolution FPGA control substrate, and the like. However, disturbance torque, such as the surface velocity (the circumferential speed) V2 of the external secondary transfer belt 114 inevitably causes sliding between a driving roller of the intermediate transfer member 106 and an inner circumferential surface of the intermediate transfer member 106.

Although the speed V3 of the sheet 110 should ideally be V1=V3, since the external secondary transfer belt 114 is driven at a constant speed, a conveyance curvature radius r of the sheet 110 in the secondary transfer portion inevitably varies by the thickness t of the sheet 110.

The sheet 110 arriving at the secondary transfer portion is fed through the conveying path 109 (see FIG. 1) as described above, and is guided by a pre-secondary-transfer guide 1144 (see FIG. 2A) to the secondary transfer portion. The sheet 110 to which the toner image on the intermediate transfer belt 106 having a predetermined circumferential speed difference with the external secondary transfer belt 114 is transferred in the secondary transfer portion is discharged toward a post-secondary-transfer guide 1145 illustrated in FIG. 2A. The sheet 110 is then conveyed by the conveying device 118 (see FIG. 1) to the fixing process mechanism unit 103 (see FIG. 1).

Block Diagram

Figure 3:
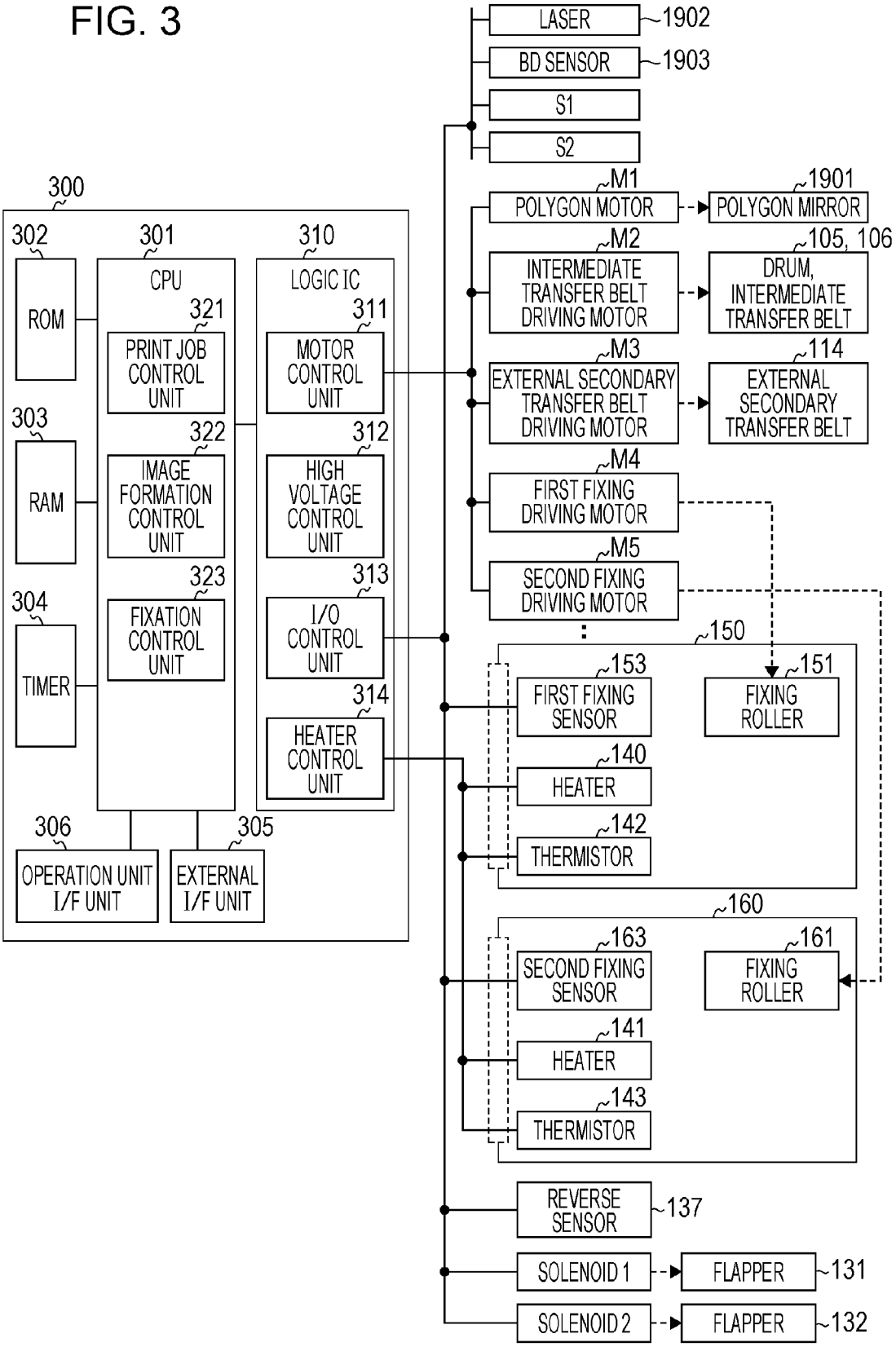
FIG. 3 is a system block diagram according to an embodiment of the present invention.

FIG. 3 is a block diagram illustrating a schematic structure of the engine control unit 300 in the present embodiment. The engine control unit 300 includes a CPU 301 which controls the image forming apparatus 100, ROM 302 storing a control program and data, RAM 303 holding setting values necessary for the control, a timer 304, and an external I/F unit 305 which communicates via a network. The engine control unit 300 further includes an operation unit I/F unit 306 which controls the user interface (the input interface, the operation unit) 180, and a logic IC 310 provided with various control functions.

In the CPU 301, a print job control unit 321, an image formation control unit 322, and a fixation control unit 323 mainly operate as a program module. The logic IC 310 includes a motor control unit 311 which drives various motors, a high voltage control unit 312 which controls high voltage in development, charging, transfer, and the like, an I/O control unit 313 which controls input and output of various sensors, and a heater control unit 314 which conducts fixing temperature adjustment control.

The motor control unit 311 controls a plurality of motors used in the image forming apparatus 100. A polygon motor M1 drives to rotate a later-described polygon mirror 1901, the intermediate transfer belt driving motor M2 drives to rotate the intermediate transfer belt 106 and the drum 105, and the external secondary transfer belt driving motor M3 drives to rotate the external secondary transfer belt 114. A first fixing driving motor M4 drives to rotate a fixing roller 151, and a second fixing driving motor M5 drives to rotate the fixing roller 161.

Patch sensors S1 and S2, the first fixing sensor 153, the second fixing sensor 163, the reverse sensor 137, and the like are connected to the I/O control unit 313. Changes in the sensor signals are notified to the CPU 301 via the I/O control unit 313. A laser 1902, a BD sensor 1903, and solenoids 1 and 2 which control flappers 131 and 132 described later are also connected to the I/O control unit 313. Control is conducted by outputting control signals from the I/O control unit 313 in response to an instruction from the CPU 301.

A heater 140 and a thermistor 142 for the first fixing unit 150, and a heater 141 and a thermistor 143 for the second fixing unit 160 are connected to the heater control unit 314. These heaters and thermistors are used for the temperature adjustment control of the first fixing unit 150 and the second fixing unit 160.

User Interface of Sheet Information Setting

FIGS. 4A to 4D are diagrams illustrating a paper sheet (a sheet) setting screen of the present embodiment. The image forming apparatus 100 of the present embodiment includes the display unit 180A in the user interface (operation unit) 180 (see FIG. 1). The display unit 180A is a touch panel integrated liquid crystal display, on which various types of information (messages) are displayed and various operation buttons (keys) are displayed by the CPU 301. A user may designate print conditions (various settings) and the like using the displayed operation buttons (keys).

Figure 4A:
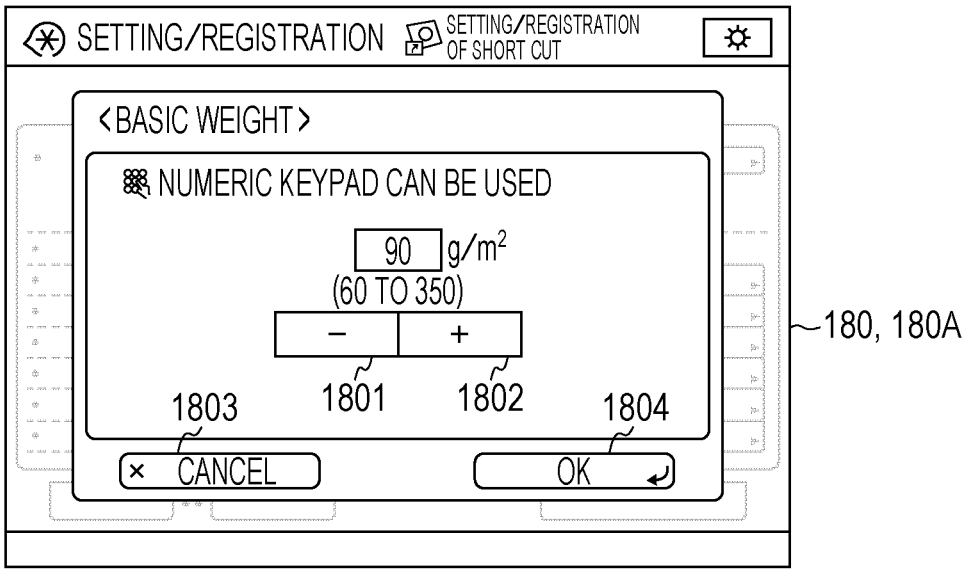
Figure 4B:
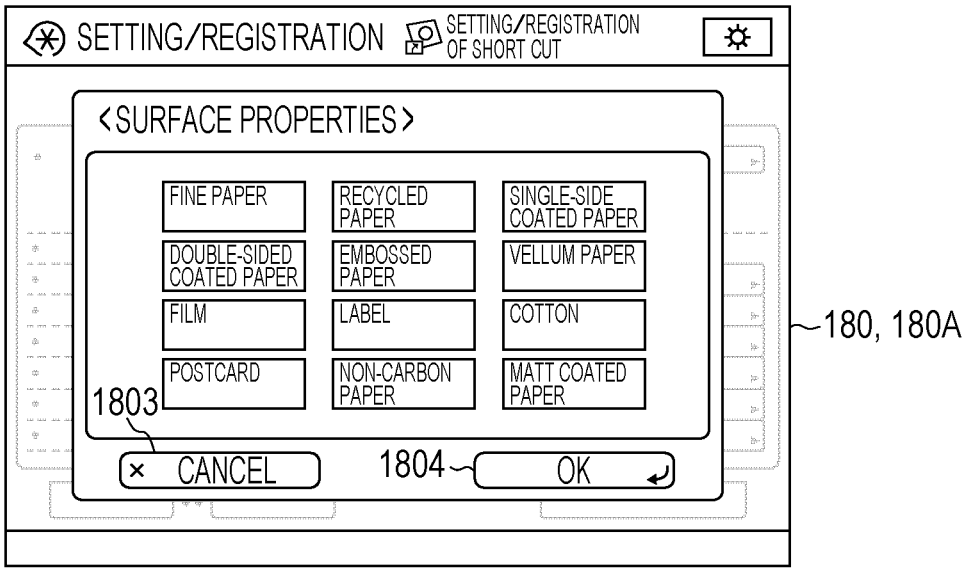

Using a screen as an input unit on which information is displayed in the display unit 180A as illustrated in FIGS. 4A to 4D, the user may arbitrarily set the sheet attributes registered in the RAM 303 of the image forming apparatus 100 on the screens of FIGS. 4A and 4B, and the condition of the job on the screen in FIG. 4D.

1) Input about External Secondary Transfer Belt Speed

In the image forming apparatus 100 of the present embodiment, the circumferential speed difference may be adjusted finely by adjusting, on the screen of FIG. 4C, the driving speed setting value of the external secondary transfer belt during printing the current sheet 110. Therefore, when the recording material stored in the container associated with the group related to the basic weight and the surface properties of the recording material is used for the image formation, the CPU 301 as the driving unit drives the driving source (the second driving source) at a speed corresponding to the group.

On the screen of FIG. 4C, the user may finely adjust the driving speed setting value of the external secondary transfer belt into a desirable value as the value of a secondary transfer circumferential speed difference in accordance with the basic weight and the type of the surface properties of the sheet by adjusting the driving speed setting value of the external secondary transfer belt depending on the selected sheet type. With the information, the information about the secondary transfer circumferential speed difference may be held for each piece of sheet attribution information. Therefore, when processing, for example, ten types of sheets in a single print job, printing may be conducted while switching the ten secondary transfer circumferential speed difference settings sequentially.

2) Input about Basic Weight of Sheet

The basic weight of the sheet may be changed arbitrarily by pressing a (−)key 1801 or a (+)key 1802 on the screen of FIG. 4A. If a change is allowed, the user presses an OK button 1804 and, if not, presses a cancel button 1803.

The image forming apparatus 100 of the present embodiment has a table as illustrated in FIG. 4E in the ROM 302. The table stores the fixing temperatures and circumferential speed differences regarding the basic weight below 150 gsm and the basic weight of 150 gsm or greater in mode 1 (the image-quality priority mode) and mode 2 (the productivity priority mode).

In the image-quality priority mode (mode 1), the control unit determines whether to conduct the correction operation (the automatic registration control) before the current image formation depending on the group associated with the container in which the recording material on which the previous image formation is conducted is stored. In the productivity priority mode (mode 2), the control unit basically does not conduct the correction operation (the automatic registration control).

The following description is given on the premise that mode 2 (the productivity priority mode) is selected in the present embodiment. The basic value of the circumferential speed difference in mode 2 (the productivity priority mode) is set to 0.6% in accordance with the basic sheet setting mainly used in the image forming apparatus.

The circumferential speed difference in the table illustrated in FIG. 4E is an amount obtained by offsetting (the circumferential speed V1 of the intermediate transfer belt 106)/(the circumferential speed V2 of the external secondary transfer belt 114) from 100%. For example, the circumferential speed difference of 1.50% means that the circumferential speed V1 of the intermediate transfer belt 106 is faster by 1.50% than the circumferential speed V2 of the external secondary transfer belt 114.

3) Input about Surface Properties of Sheet

In the image forming apparatus 100 of the present embodiment, the type about the surface properties of the sheet (paper sheet) may be selected on the screen of FIG. 4B.

4) Input about Fixing Unit Temperature Mode

FIG. 4D is a screen on which job execution is optimized, and is a screen on which fixing temperature adjustment modes are switched. In the image forming apparatus 100 of the present embodiment, several patterns of fixing unit temperature modes may be selected depending on the basic weight of the sheet that can be set on the screen of FIG. 4A.

As illustrated in FIG. 4E, in the image-quality priority mode, the fixing temperature is changed depending on the basic weight. That is, in the image-quality priority mode, in a job in which a thin paper sheet and a cardboard sheet are used together, the fixing temperature of the first fixing unit 150 is adjusted to the adjusted temperature (hereafter, "fixing temperature") to obtain the optimal glossiness (glossy feeling) in each sheet. While the optimal glossiness is obtained, downtime occurs until the fixing temperature becomes a predetermined state (the image-quality priority mode: mode 1).

In the productivity priority mode, as in the present embodiment, the job is conducted at a common fixing temperature at which neither of the thin paper sheet nor the cardboard sheet obtains the optimal glossiness but both of them obtain fixability to the extent not to cause a substantial failure. Then, although the glossiness is not optimal, downtime due to switching does not occur.

On the screen of FIG. 4D, the image-quality priority mode (mode 1) may be selected with an image-quality priority button 1806 and the productivity priority mode (mode 2) may be selected with a productivity priority button 1805 as the input unit. If a change is allowed, the user presses an OK button 1808 and, if not, presses a cancel button 1807.

Automatic Registration Control

Hereafter, the automatic registration control according to the present embodiment is described with reference to the schematic diagrams of the automatic registration control as the correction operation using a color misalignment correction control means illustrated in FIGS. 5A and 5B.

In the present embodiment, a correction operation to correct image misalignment on the basis of a detection result of a test toner image formed on the intermediate transfer member is conducted as the automatic registration control in a period in which no toner image exists in the transfer portion (the secondary transfer portion) (executed by the CPU 301 as an execution unit).

Figure 5A:
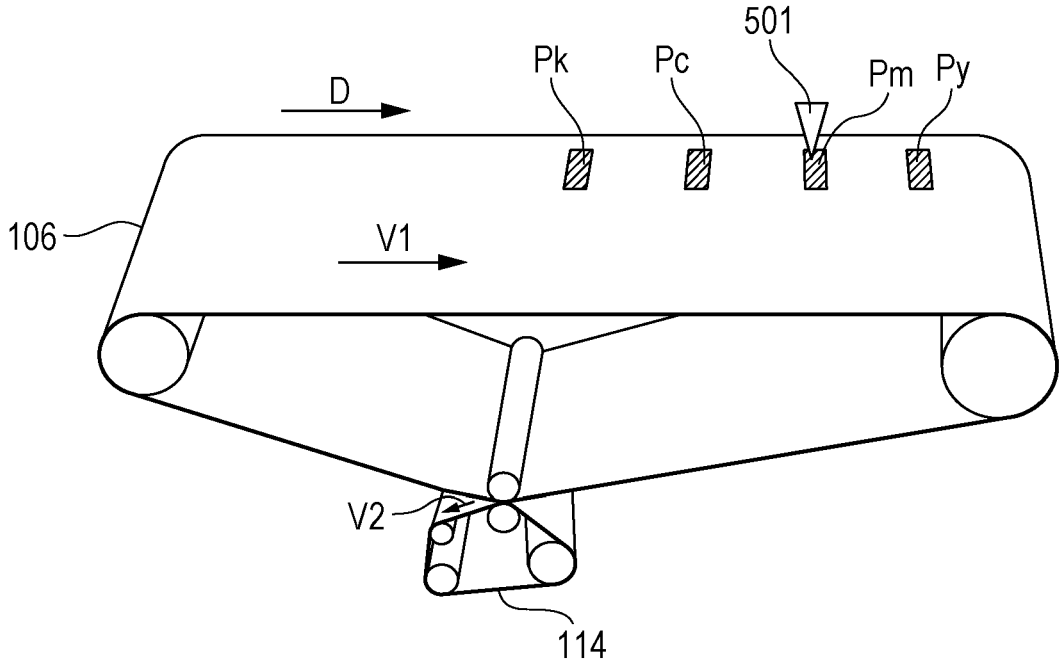
FIGS. 5A and 5B are diagrams illustrating automatic registration control of an image forming apparatus according to an embodiment of the present invention.
Figure 5B:
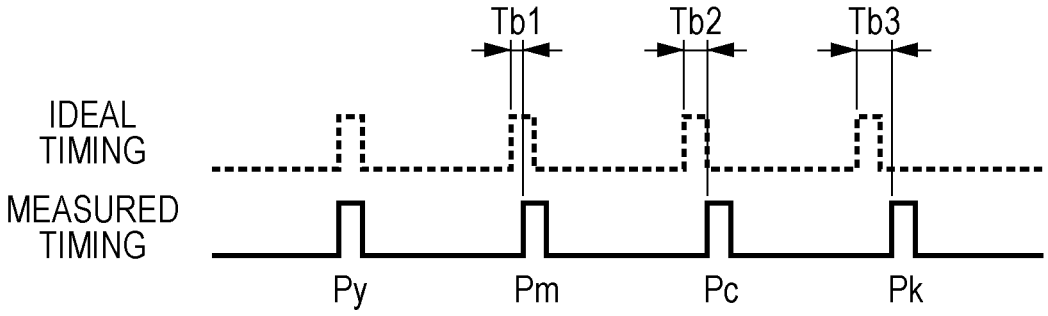

The intermediate transfer member 106 travels at a surface velocity of V1 in the direction of arrow D of FIG. 5A. Regarding the automatic registration control, methods for correcting geometrical characteristics of the image, such as image misalignment, tilt, and main scanning magnification of each image station 120, 121, 122 and 123, are widely known. Here, positional correction among 4 colors of Y, M, C and K in the sub-scanning direction (the traveling direction of the intermediate transfer member 106) is described.

First, each of the laser scanners 108 exposes in each color of Y, M, C and K at time intervals corresponding to the time of drum pitch intervals to form patches Py, Pm, Pc, and Pk of each color as patterns for detection of image misalignment on the intermediate transfer member 106. Timing waveforms illustrated in FIG. 5B are acquirable by sampling and reading (i.e., detecting) the patches by a sensor 501. Therefore, each of the laser scanners 108 starts exposure with a delay to the time of drum pitch intervals by delays Tb1, Tb2 and Tb3 as gaps with ideal detection timing with respect to the reference color (Y). In this manner, the relative positional relationships between colors on the intermediate transfer member 106 can be brought closer to desired values.

The delays Tb1, Tb2 and Tb3 are obtained by measuring the patches formed on the intermediate transfer member 106. On the basis of the result, registration control of colors among Y, M, C and K is conducted. After generation of the reference color of Y elapses and each time of delays Tb1, Tb2 and Tb3 is added to the time of drum pitch intervals, generation of images of M, C and K is started. That is, by measuring the surface velocity V1 in each state of the intermediate transfer member 106 with the patches, exposure timing is adjusted and relative positions of all the colors of Y, M, C and K is aligned on the intermediate transfer member 106 (the automatic registration control).

The surface velocity of the intermediate transfer member 106 changes with time due to fluctuation in the surface state of the intermediate transfer member 106 or fluctuation in the friction state with the external secondary transfer belt 114. When the driving speed of the external secondary transfer belt 114 is changed, the driving speed of the intermediate transfer member 106 is changed slightly. However, if the set driving speed of the external secondary transfer belt 114 is about less than 0.9% (i.e., if the change in the speed control value does not exceed a prescribed range), since it is known that the change does not greatly affects the speed V1 on the intermediate transfer member 106, re-conduction of the automatic registration control is unnecessary. In the present embodiment, the automatic registration control is conducted when the change in the speed control value exceeds a prescribed range.

If the automatic registration control is conducted, a series of control to print the patches of the automatic registration control on the intermediate transfer belt 106, and collect the patches by the external secondary transfer belt 114 and cleaning mechanisms near the external secondary transfer belt 114. This may cause considerably long downtime.

Existence of Automatic Registration Control in Present Embodiment

Since mode 2 (the productivity priority mode) is selected in the present embodiment, the secondary transfer circumferential speed difference is set to 0.6% (in the reference range of the speed difference with the intermediate transfer member) basically irrespective of the basic weight setting of the sheet 110. Therefore, the automatic registration control is not conducted and no downtime for the automatic registration control occurs.

Specifically, the adjustment range of the speed setting value of the external secondary transfer belt set on the screen of FIG. 4C is as small as ±0.15%. Therefore, in a job in which sheets 110 of different settings are used together, since load fluctuation to the intermediate transfer member 106 when no sheet exists in the secondary transfer portion is small enough, it is not necessary to conduct the automatic registration control for every sheet setting. Therefore, downtime does not occur for the automatic registration control.

Flowchart of Present Embodiment

Figure 6:
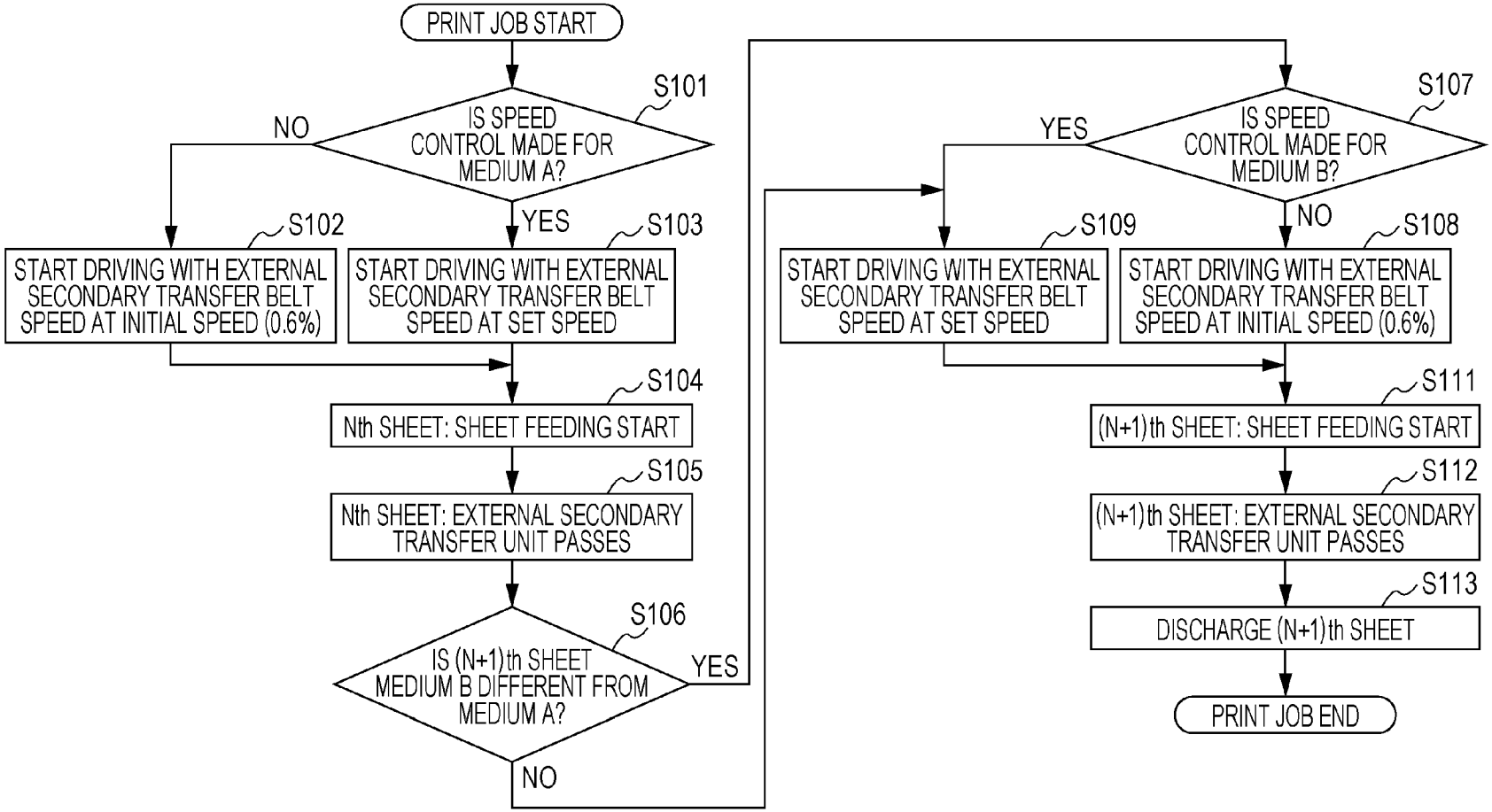
FIG. 6 is a control flowchart according to a first embodiment.

FIG. 6 is a flowchart about the change in the speed of the external secondary transfer belt 114 in the image forming apparatus 100 of the present embodiment. This process flow is executed in the CPU 301 as a speed control means (see FIG. 3). When a print job is started, the sheet attribution information (the basic weight and the surface properties) and the existence of the speed control input on the screen of FIG. 4C are checked (S101).

If the speed control is conducted via the screen illustrated in FIG. 4C as the input unit, the circumferential speed difference setting value is changed by 0.05% per unit depending on the input value of the speed control, and driving of the external secondary transfer belt is started (S103). If no speed control is conducted via the screen illustrated in FIG. 4C as the input unit, driving of the external secondary transfer belt is started at the initial speed (0.6%) (S102).

The Nth sheet 110 is fed (S104) and, after the trailing end of the Nth sheet 110 passes through the secondary transfer portion (S105), whether the secondary transfer speed control value of the Nth sheet and the secondary transfer speed control value of the (N+1)th sheet are the same is determined (S106). If the speed control is conducted (S107), the circumferential speed difference setting value is changed in accordance with the sheet attribution information of the (N+1)th sheet in a period before the feeding of the (N+1)th sheet is started (S109).

Since the circumferential speed difference may be adjusted finely independently about the Nth sheet and the (N+1)th sheet, high definition secondary transfer with a small relative speed difference between the sheet 110 and the intermediate transfer member 106 may be conducted and the print job may be completed (S113).

Exemplary Print Job According to Present Embodiment

Figure 7A:
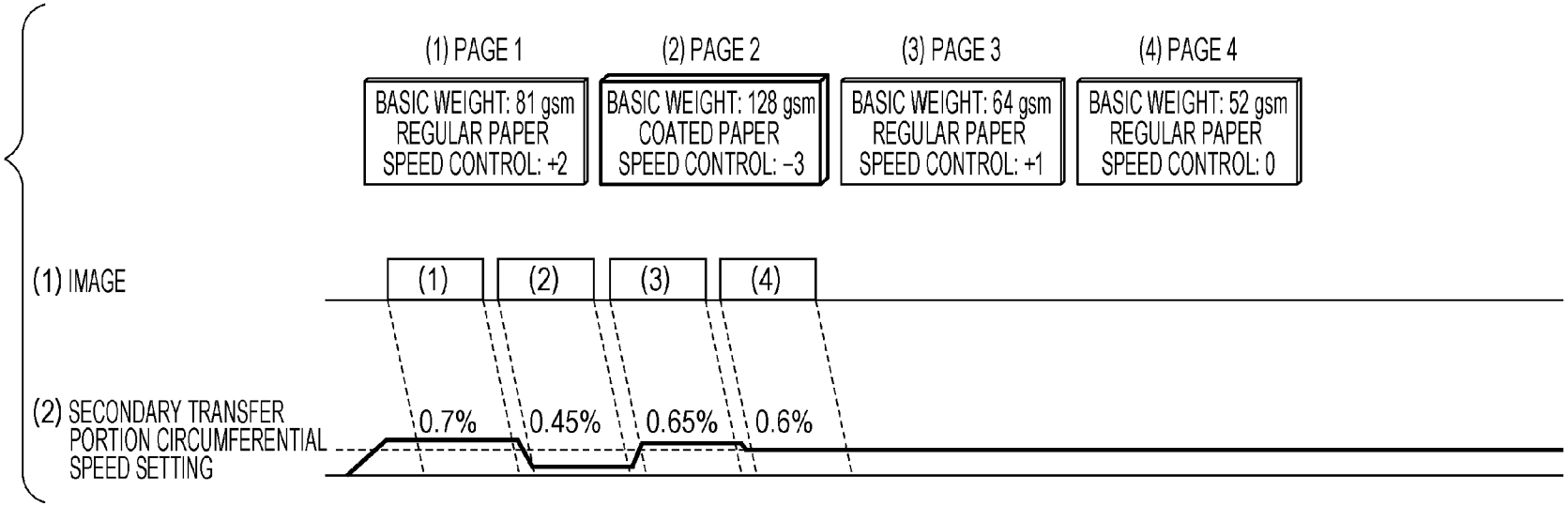
FIG. 7A is a diagram illustrating an exemplary job according to the first embodiment.
Figure 7B:
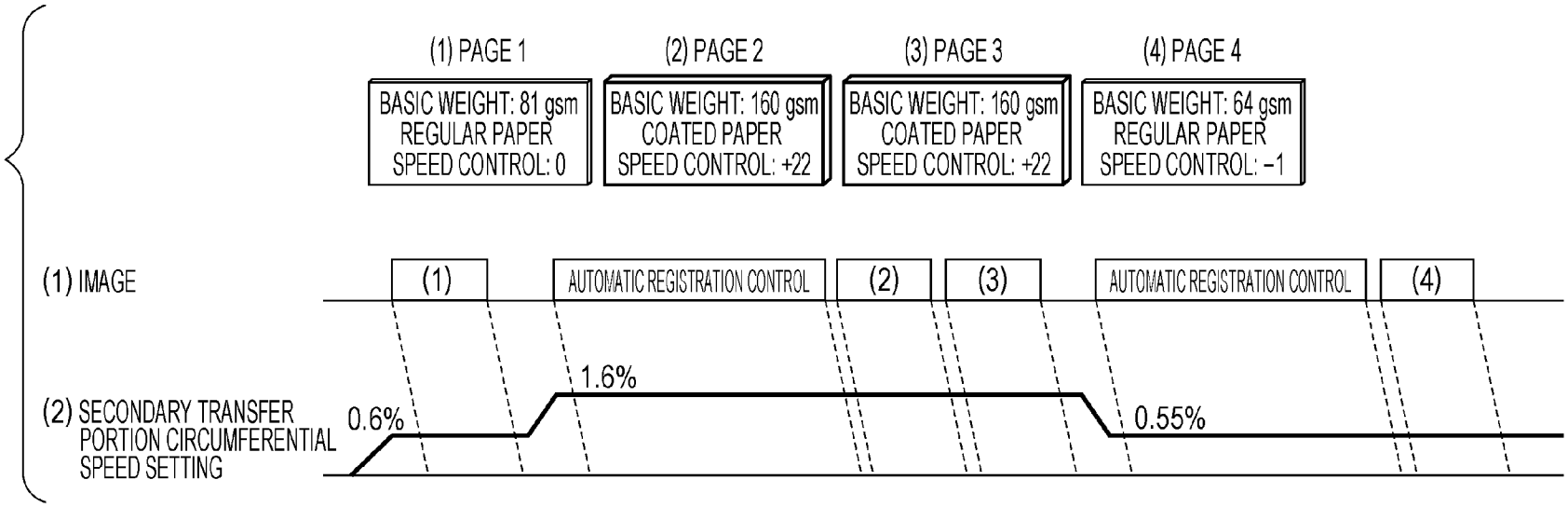
FIG. 7B is a diagram illustrating an exemplary job according to a second embodiment.

FIGS. 7A and 7B are timing charts of exemplary job printing by the image forming apparatus 100 of the present embodiment. FIG. 7A illustrates four pages in job example 1 printed sequentially in mode 2 (the productivity priority mode). Pages 1 to 4 have different settings in the basic weight and the surface properties and have +2, −3, +1 and 0 as the input of the speed control values, respectively.

Since the circumferential speed difference of page 1 is 0.7% and the circumferential speed difference of the subsequent page 2 is 0.45%, the circumferential speed difference of the external secondary transfer belt 114 is changed to 0.45% after page 1 passes through the secondary transfer portion. Similarly, the circumferential speed difference of the external secondary transfer belt 114 is changed to 0.65% after page 2 passes through the secondary transfer portion, and the circumferential speed difference of the external secondary transfer belt 114 is changed to 0.6% after page 3 passes through the secondary transfer portion.

As described above, in the present embodiment, it is possible to provide the optimal circumferential speed difference of the secondary transfer portion in accordance with image quality of a product by finely adjusting the circumferential speed difference for each sheet. Therefore, image quality optimal to each sheet type is achieved.

Second Embodiment

Hereafter, a second embodiment of the present invention will be described.

Existence of Automatic Registration Control in Present Embodiment

Also in the present embodiment, since mode 2 (the productivity priority mode) is selected, the secondary transfer circumferential speed difference is set to 0.6% basically irrespective of the basic weight setting of the sheet 110. Therefore, the automatic registration control is not conducted basically and no downtime for the automatic registration control occurs. However, unlike the first embodiment, an adjustable range of the speed setting value of the external secondary transfer belt set on the screen of FIG. 4C is a greater range exceeding the small range of ±0.15%. Therefore, if a difference between the first setting value and the initial value, or a difference between the current setting value and the previously set value in a case in which a recording material different from that of the previous time is used exceeds a predetermined value, the automatic registration control is conducted.

Figure 8:
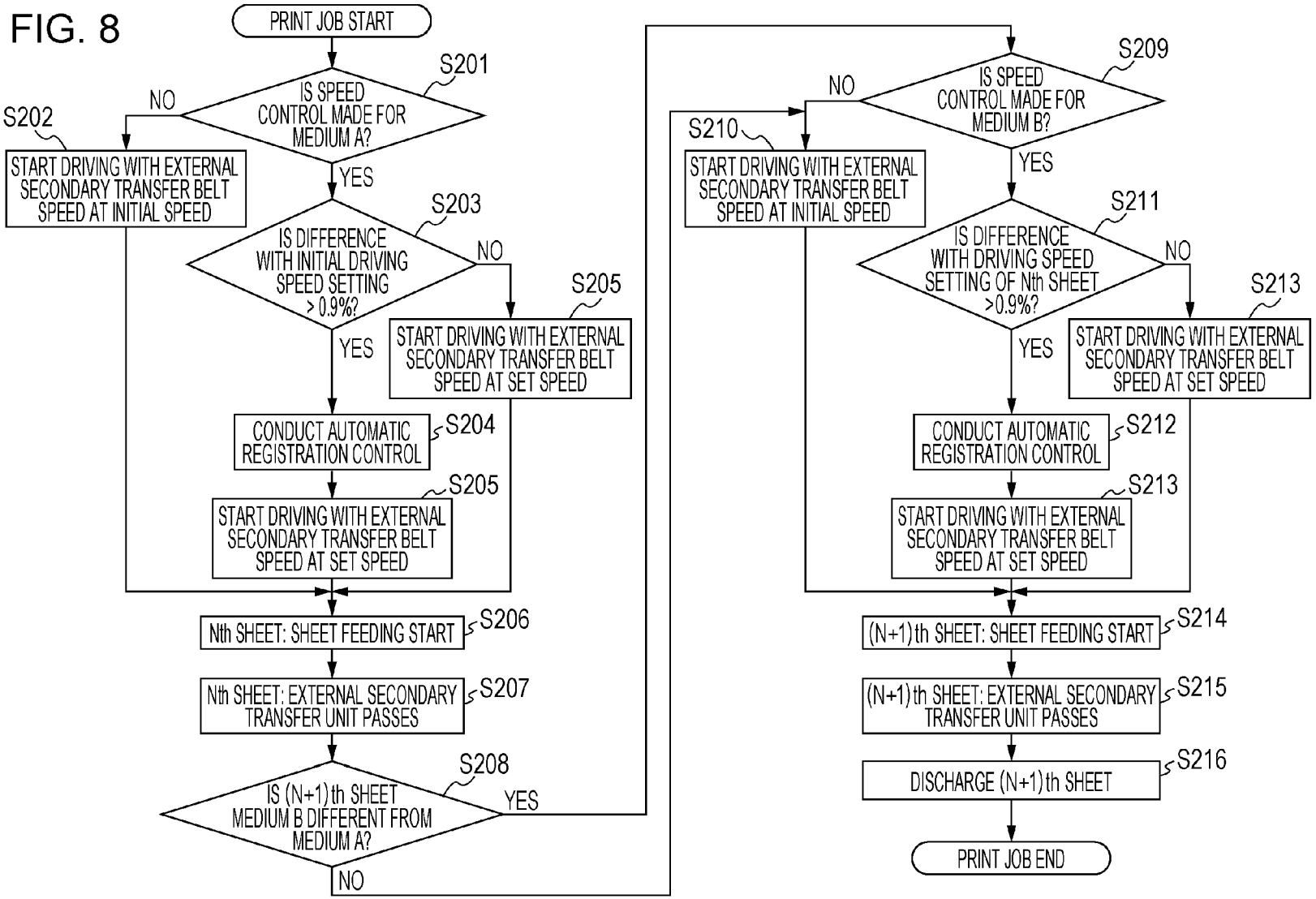
FIG. 8 is a control flowchart according to the second embodiment.

Hereafter, the second embodiment of the present invention is described in more detail with reference to FIGS. 7B and 8. FIG. 8 is a flowchart about the change in the speed of the external secondary transfer belt 114 in the present embodiment. This process flow is executed in the CPU 301.

When a print job is started, the existence of the speed control of the external secondary transfer belt input on the screen of FIG. 4C is checked (S201). The circumferential speed difference setting value is changed by 0.05% per unit depending on the speed control input value. At this time, whether the difference (the speed change) with the setting value (the speed control value) to the initial circumferential speed difference of 0.6% is 0.9% or greater is determined (S203). If the difference is 0.9% or greater, the automatic registration control is conducted (S204) before driving of the external secondary transfer belt is started (S205).

The Nth sheet 110 is fed (S206) and, after the trailing end of the Nth sheet 110 passes through the secondary transfer portion (S207), whether the secondary transfer speed control value of the Nth sheet and the secondary transfer speed control value of the (N+1)th sheet are the same is determined (S208). If the secondary transfer speed control is conducted (S209), whether the difference (the speed change) with the circumferential speed difference setting value to the Nth sheet exceeds a predetermined value (0.9% or greater) is determined (S211). If the difference is 0.9% or greater, the automatic registration control is conducted (S212) before driving of the external secondary transfer belt is started (S213).

Also in the present embodiment, since the circumferential speed difference may be adjusted finely independently about the Nth sheet and the (N+1)th sheet, high definition secondary transfer with a small relative speed difference between the sheet 110 and the intermediate transfer member 106 is conducted and the print job is completed (S216).

Exemplary Print Job According to Present Embodiment

Hereinafter, an exemplary print job in the present embodiment is described with reference to FIG. 7B. Pages 1 to 4 have different settings in the basic weight and the surface properties and have 0, +22, +22 and −1 as the input of the speed control values, respectively. The circumferential speed difference of page 1 is 0.6%, which is the basic value, whereas the circumferential speed difference of the subsequent page 2 is 1.6%. Therefore, the set circumferential speed difference between page 1 and page 2 is 0.9% or greater. Therefore, the automatic registration control is conducted after page 1 passes through the secondary transfer portion and the circumferential speed difference of the external secondary transfer belt 114 is changed to 1.6%.

Although page 2 is fed after the automatic registration control is completed, since the circumferential speed difference setting of page 3 is the same as the circumferential speed difference setting of page 2, it is not necessary to change the circumferential speed difference of the external secondary transfer belt 114 after page 2 passes through the secondary transfer portion or to conduct the automatic registration control between feeding of page 2 and feeding of page 3. After page 3 passes through the secondary transfer portion, the circumferential speed difference of the subsequent page 4 is 0.55%. Therefore, the set circumferential speed difference between page 3 and page 4 is 0.9% or greater. If the circumferential speed difference of the external secondary transfer belt 114 is changed to 0.55%, automatic registration control is conducted.

As described above, according to the present embodiment, as in the first embodiment, it is possible to provide the circumferential speed difference of the secondary transfer portion optimal to various types of sheets from thin paper to cardboard and, the maximum productivity is realizable while reducing the number of times of conducting the automatic registration control to the minimum.

Other Embodiments

Preferred Embodiments of the Present Invention have been described, but the present invention is not limited to the same. Various modifications and changes may be made without departing from the scope of the present invention.

Other Embodiment 1

In the above embodiments, the user inputs the basic weight and the type of the surface properties of the sheet which is the recording medium in a first screen display of the input interface and inputs the surface velocity of the secondary transfer member which is adjustable in a second screen display of the input interface. However, the present invention is not limited to the same. The user may input, in the first input screen of the input interface, the basic weight and the type of surface properties of the sheet which is the recording medium, and the apparatus may automatically set the surface velocity of the secondary transfer member to the value suitable for the basic weight and the surface properties of the sheet. In this case, the user cannot directly adjust the surface velocity of the secondary transfer member.

Other Embodiment 2

Although the surface velocity of the secondary transfer member is considered to be lower than the surface velocity of the intermediate transfer member in the above embodiments, the surface velocity of the secondary transfer member may be considered to be higher than the surface velocity of the intermediate transfer member.

Other Embodiment 3

Although the external secondary transfer belt 114 is used as the secondary transfer member in the above embodiments, an external secondary transfer roller may be used as the secondary transfer member. In that case, however, since a sheet does not stick to the external secondary transfer roller, it is necessary to maintain the conveyance speed of the sheet at substantially the same as the surface velocity of the intermediate transfer member.

According to the present invention, the speed of the transfer member that transfers the toner image on the intermediate transfer member to the recording material in the transfer portion can be set to the speed corresponding to the group related to the basic weight and the surface properties of the recording material via the input unit.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-160539, filed Aug. 17, 2015, which is hereby incorporated by reference herein in its entirety.

What is claimed is:

1. An image forming apparatus, comprising:

an image forming unit configured to form a toner image;

a toner bearing member configured to bear the toner image formed by the image forming unit;

a transfer member configured to form a transfer nip with the toner bearing member for nipping a recording material and to transfer the toner image born by the toner bearing member to the recording material;

a speed control unit configured to control a speed difference between the transfer member and the toner bearing member based on a type of the recording material;

a control unit configured to execute a registration correction mode in which an image formation condition of the image forming unit is controlled on the basis of a registration patch during a continuous image formation job, the control unit executing the registration correction mode in a case that a changed amount of the speed difference between the transfer member and the toner bearing member by the speed control unit exceeds a predetermined range, and not executing the registration correction mode in a case that the changed amount of the speed difference between the transfer member and the toner bearing member by the speed control unit does not exceed the predetermined range; and an input unit configured to input a signal for setting an image formation mode, wherein the control unit controls an image formation during the image formation mode so that the changed amount of speed by the speed control unit is limited to less than the predetermined range regardless of a type of the recording material.

2. The image forming apparatus according to claim 1, wherein the transfer member is a belt member.

3. The image forming apparatus according to claim 1, further comprising a container configured to contain a recording material, wherein the input unit is capable of setting the type of the recording material contained in the container, and wherein the speed control unit controls the speed difference between the transfer member and the toner bearing member set during image formation based on information input in the input unit.

4. The image forming apparatus according to claim 1, wherein the type of the recording material is at least based on surface properties of the recording material.

5. An image forming apparatus, comprising:

a first bearing member;

a second bearing member;

a first image forming unit configured to form a first toner image on the first bearing member;

a second image forming unit configured to form a second toner image on the second bearing member;

an intermediate transfer member to which the first toner image formed on the first bearing member and the second toner image formed on the second bearing member are respectively transferred, wherein the first toner image and the second toner image are transferred to the intermediate transfer member by being overlapped with each other, a transfer member configured to form a transfer nip with the intermediate transfer member for nipping a recording material and to transfer the first toner image and the second toner image born by the intermediate transfer member to the recording material;

a first motor configured to drive the intermediate transfer member;

a second motor configured to drive the transfer member;

a controller configured to control the first motor and the second motor;

an operation unit capable of inputting a type of recording material;

wherein the controller is capable of changing a rotational speed ratio between a rotational speed of the transfer member and a rotational speed of the intermediate transfer member by changing a driving speed of the second motor, wherein, during a continuous image formation job for continuously forming images on a plurality of recording materials, the controller is configured to execute a registration correction mode for registration correction in which a first registration patch formed on the first bearing member and a second registration patch formed on the second bearing member are transferred respectively to the intermediate transfer member, and wherein the registration correction mode is a mode executed based on a changed amount between the rotational speed ratio that is set while a first recording material passes through the transfer nip and the rotational speed ratio that is set while a second recording material that follows the first recording material passes through the transfer nip, and the controller is configured to execute the registration correction mode after an image is formed on the first recording material and before an image is formed on the second recording material.

6. The image forming apparatus according to claim 5, wherein the transfer member is a belt member.

7. The image forming apparatus according to claim 5, further comprising a cassette configured to contain recording material, wherein the operation unit is configured to input the type of recording material contained in the cassette.

8. The image forming apparatus according to claim 5, wherein the type of recording material is at least based on surface properties of the recording material.

9. The image forming apparatus according to claim 5, wherein in a case that the changed amount exceeds a predetermined amount, the controller is configured to execute the registration correction mode, and in a case that the changed amount is the predetermined amount or less, the controller is configured to form the image on the second recording material without executing the registration correction mode.

10. The image forming apparatus according to claim 5, wherein the controller is configured to selectively execute a plurality of image forming modes including a first image forming mode in which the controller limits the changed amount to a predetermined amount or less during image formation regardless of the type of recording material to be subjected to image formation so as not to execute the registration correction mode, and a second image forming mode in which the controller allows the changed amount to exceed the predetermined amount during image formation and is capable of executing the registration correction mode.

11. An image forming apparatus, comprising;

a first bearing member;

a second bearing member;

a first image forming unit configured to form a first toner image on the first bearing member;

a second image forming unit configured to form a second toner image on the second bearing member;

an intermediate transfer member to which the first toner image formed on the first bearing member and the second toner image formed on the second bearing member are respectively transferred, wherein the first toner image and the second toner image are transferred to the intermediate transfer member by being overlapped with each other, a transfer member configured to form a transfer nip with the intermediate transfer member for nipping a recording material and to transfer the first toner image and the second toner image born by the intermediate transfer member to the recording material;

a first motor configured to drive the intermediate transfer member;

a second motor configured to drive the transfer member;

a controller configured to control the first motor and the second motor;

an operation unit capable of inputting a type of recording material;

wherein the controller is capable of changing a rotational speed ratio between a rotational speed of the transfer member and a rotational speed of the intermediate transfer member by changing a driving speed of the second motor according to the type of recording material inputted from the operation unit, wherein, during a continuous image formation job for continuously forming images on a plurality of recording materials, the controller is configured to execute a registration correction mode for registration correction in which a first registration patch formed on the first bearing member and a second registration patch formed on the second bearing member are transferred respectively to the intermediate transfer member, and wherein the registration correction mode is a mode executed in a case that a changed amount between the rotational speed ratio that is set while a first recording material passes through the transfer nip and the rotational speed ratio that is set while a second recording material that follows the first recording material passes through the transfer nip in the continuous image formation job is more than a predetermined amount.

12. The image forming apparatus according to claim 11, wherein the transfer member is a belt member having an elastic layer.

13. The image forming apparatus according to claim 11, wherein the controller is configured to selectively execute a plurality of image forming modes including a first image forming mode in which the controller limits the changed amount to the predetermined amount or less during an image formation regardless of the type of recording material, and a second image forming mode in which the controller allows the changed amount to exceed the predetermined amount during image formation.

* * * * *